US010883365B2

(12) United States Patent
Naveena-Chandran

(10) Patent No.: US 10,883,365 B2
(45) Date of Patent: Jan. 5, 2021

(54) EMBEDDABLE DOWNHOLE PROBE

(71) Applicant: Halliburton Energy Services, Inc., Houston, TX (US)

(72) Inventor: Rohin Naveena-Chandran, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 147 days.

(21) Appl. No.: 16/179,814

(22) Filed: Nov. 2, 2018

(65) Prior Publication Data

US 2019/0145252 A1 May 16, 2019

Related U.S. Application Data

(60) Provisional application No. 62/587,359, filed on Nov. 16, 2017.

(51) Int. Cl.

| | |
|---|---|
| ***E21B 49/00*** | (2006.01) |
| ***E21B 47/07*** | (2012.01) |
| ***E21B 49/06*** | (2006.01) |
| ***E21B 47/06*** | (2012.01) |
| ***E21B 49/10*** | (2006.01) |
| *E21B 43/267* | (2006.01) |
| *E21B 43/26* | (2006.01) |
| *E21B 33/12* | (2006.01) |

(52) U.S. Cl.

CPC ..... *E21B 49/008* (2013.01); *E21B 47/06* (2013.01); *E21B 47/07* (2020.05); *E21B 49/006* (2013.01); *E21B 49/06* (2013.01); *E21B 49/10* (2013.01); *E21B 33/12* (2013.01); *E21B 43/26* (2013.01); *E21B 43/267* (2013.01)

(58) Field of Classification Search

CPC ..... E21B 49/008; E21B 47/07; E21B 49/006; E21B 49/06; E21B 47/06; E21B 49/10; E21B 33/12; E21B 43/267; E21B 43/26; E21B 49/08

See application file for complete search history.

(56) References Cited

U.S. PATENT DOCUMENTS

| | | | | |
|---|---|---|---|---|
| 6,164,126 | A | 12/2000 | Ciglenec et al. | |
| 6,769,296 | B2 * | 8/2004 | Montalvo | E21B 49/10 73/152.22 |
| 7,178,392 | B2 * | 2/2007 | Dhruva | E21B 49/008 73/152.51 |

(Continued)

*Primary Examiner* — Michael R Wills, III

(57) ABSTRACT

A downhole probe assembly is employed in a wellbore to mitigate the effects of hoop stress on the operation of the probe assembly. A shaped head is driven radially into the geologic formation surrounding the wellbore. A sensor and/or fluid ports may thereby be delivered to a radial depth in the geologic formation beyond a hoop stress regime associated with the wellbore. In this manner, analysis and fluid communication with the geologic formation may not be hindered by the hoop stress regime surrounding the wellbore. The probe assembly may be employed in microfracture tests in which fluid is injected into geologic formation through mechanical fractures created by the shaped heads extending through the hoop stress regime. The fluid injected through the hoop stress regime may more readily interact with the geologic formation, and subsequent analysis of the injected fluids may yield more relevant information about the geologic formation.

20 Claims, 8 Drawing Sheets

(56) References Cited

U.S. PATENT DOCUMENTS

| | | | | |
|---|---|---|---|---|
| 8,499,831 | B2 * | 8/2013 | Church | E21B 49/081 166/100 |
| 8,714,246 | B2 * | 5/2014 | Pop | E21B 7/04 166/264 |
| 2014/0353479 | A1 * | 12/2014 | Edwards | G01V 8/00 250/255 |
| 2015/0167442 | A1 * | 6/2015 | Harfoushian | E21B 49/082 166/264 |
| 2017/0292359 | A1 * | 10/2017 | Irani | E21B 49/10 |

* cited by examiner

EMBEDDABLE DOWNHOLE PROBE

CROSS-REFERENCE TO RELATED APPLICATION(S)

This application claims priority to U.S. Provisional Patent Application No. 62/587,359 filed on Nov. 16, 2017 and entitled "Embeddable Downhole Probe," which is incorporated by reference herein in its entirety.

BACKGROUND

The present disclosure relates generally to subterranean tools and methods for accessing geologic formations through a wellbore. More particularly, embodiments of the disclosure include a probe that may be embedded into the geologic formation beyond an area of localized hoop stress in the formation around the wellbore.

During the drilling and completion of oil and gas wells in a geologic formation, it may be necessary to engage in ancillary operations, such as perforating, fracturing or chemically treating the formation to enhance production, or monitoring and evaluating the formation. For example, after a wellbore, or an interval of the wellbore, has been drilled, zones of interest are often tested to determine various formation properties such as permeability, fluid type, fluid quality, formation temperature, formation pressure, bubble-point and formation pressure gradient. Likewise, these zones may be isolated and subject to chemical treatment, such as acidizing, or the zones may be subjected to hydraulic fracturing and or injection of proppant to enhance recovery.

In each of these instances, it is necessary to interact with the formation. One of the challenges of interacting or otherwise communicating with the formation is to overcome hoop stress that is localized around the circumference of the wellbore. Hoop stress may be created by mud additives and invasion that creates a stress barrier between the pore pressure and wellbore hydrostatic pressure. Although such hoop stress is desirable in well control, it can be an impediment to the forgoing activities.

To the extent the formation is being tested, it is common in the prior art to utilize a probe assembly to contact the wellbore wall. Typically, a probe assembly includes a probe pad that is extended radially outward until the pad contacts the wellbore wall. The pad may be carried on a retractable mechanical arm or may be affixed to a reciprocating piston that can be selectively extended radially from a probe tool. The pad may include a snorkel to evaluate or interact with drawn down formation fluids at the point of contact with the wellbore wall and/or sensors to sense one or more local characteristics of the formation, such as formation temperature or pressure.

One drawback to the prior art probes as described is that communication with the formation can be hindered by the hoop stress. For example, hoop stress at the wellbore wall may impact fluid flow from the formation into the probe. Likewise, hoop stress may impact the accuracy of various formation measurements that may be taken at the wellbore wall.

BRIEF DESCRIPTION OF THE DRAWINGS

The disclosure is described in detail hereinafter, by way of example only, on the basis of examples represented in the accompanying figures, in which.

DETAILED DESCRIPTION

The present disclosure provides for a downhole probe assembly that can be utilized in a wellbore to mitigate the effects of hoop stress on operation of the probe by altering the stress regime in a confined environment. In particular, the disclosure provides for a downhole probe assembly having a shaped probe head that can be driven into and a formation and embedded in the formation to a radial depth in the formation that is beyond the hoop stress regime associated with the wellbore.

Figure 1:
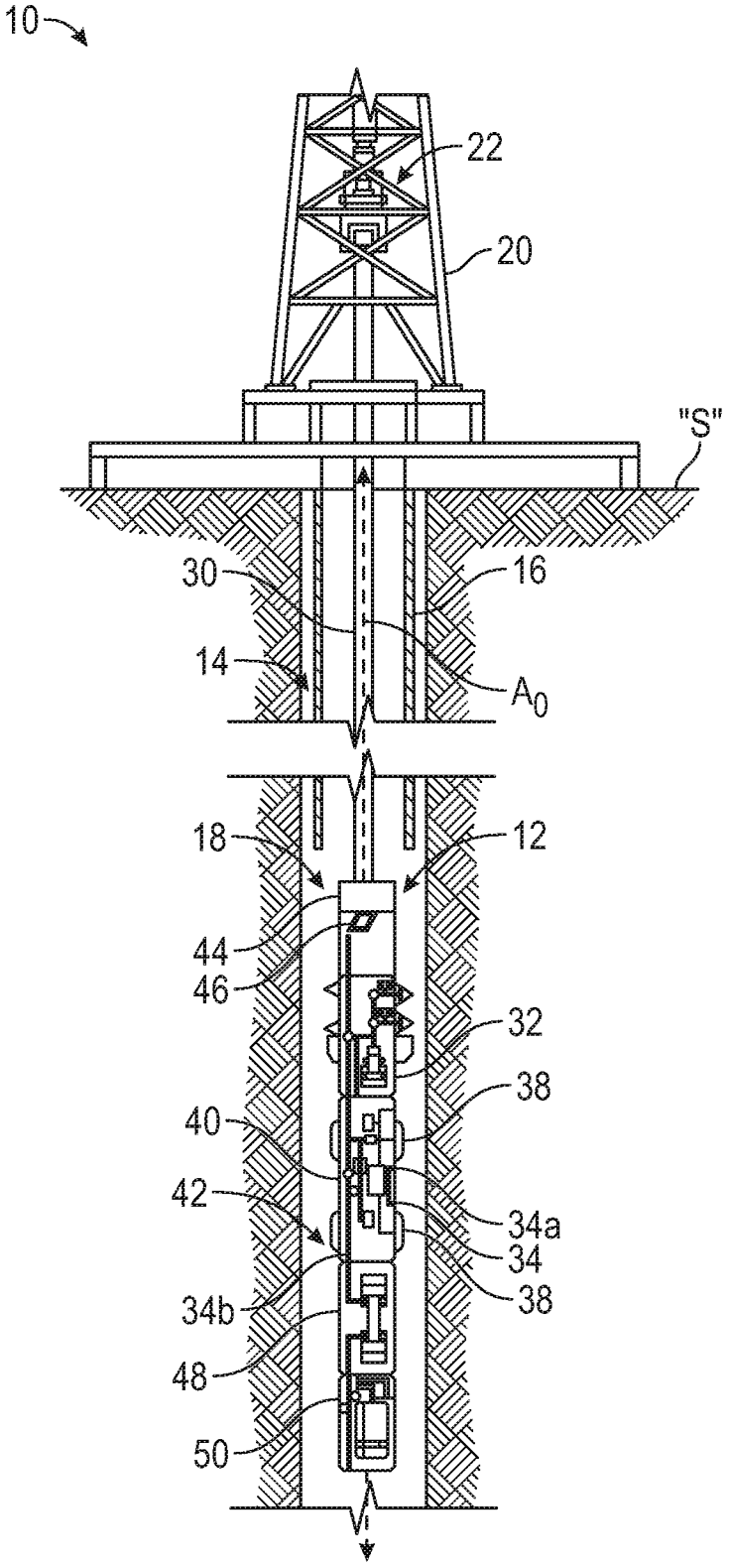
FIG. 1 is a partial cross-sectional side view a wellbore system in which a probe assembly in accordance with embodiments of the present disclosure is deployed a downhole location within a wellbore extending through a geologic formation.

An example embodiment of a wellbore system 10 including a probe assembly 12 is illustrated in FIG. 1. The probe assembly 10 is deployed in a wellbore 14 extending through a geologic formation "G" from a terrestrial or land-based surface location "S." In other embodiments, a wellbore may extend from offshore or subsea surface locations (not shown) using with appropriate equipment such as offshore platforms, drill ships, semi-submersibles and drilling barges. The wellbore 14 defines an "uphole" direction referring to a portion of wellbore 14 that is closer to the surface location "S" and a "downhole" direction referring to a portion of wellbore 14 that is further from the surface location "S."

Wellbore 14 is illustrated in a generally vertical orientation extending along an axis $A_O$. In other embodiments, the wellbore 14 may include portions in alternate deviated orientations such as horizontal, slanted or curved without departing from the scope of the present disclosure. Wellbore 14 optionally includes a casing string 16 therein, which extends generally from the surface location "S" to a selected downhole depth. Casing string 16 may be constructed of distinct casing or pipe sections coupled to one another in an end-to-end configuration. Portions of the wellbore 14 that do not include casing string 16, e.g., downhole portion 18, may be described as "open hole."

Wellbore system 10 includes a derrick or rig 20 at the surface location "S." Rig 20 may include surface equipment 22, e.g., as a hoisting apparatus, travel block, swivel, kelly, rotary table, etc., for raising, lowering and rotating a conveyance 30 such as a tubing string. Other types of conveyance include tubulars such as drill pipe, a work string, coiled tubing production tubing (including production liner and production casing), and/or other types of pipe or tubing strings collectively referred to herein as a tubing string. Still other types of conveyances include wirelines, slicklines or cables, which may be used, e.g., in embodiments where fluid flow to the probe assembly 12 is not required. The probe assembly 12 may be conveyed by wireline, which may be less cumbersome in some embodiments, than a tubing string. A tubing string may be constructed of a plurality of pipe joints coupled together end-to-end, or as a continuous tubing string, supporting the probe assembly 12 as described below.

The probe assembly 12 as described herein is not limited to a particular downhole operation, conveyance 30 or conveyance, and may be utilized in any drilling or production activity. For example, the probe assembly 12 may be incorporated on a drill string or bottom hole assembly as part of a measurement while drilling (MWD) or logging while drilling (LWD) system (not shown), may be deployed on a wireline, slickline, coiled tubing or other type of cable or tubing system, or may be utilized in production operations.

Coupled to a downhole end of the conveyance 30 and illustrated within the open hole portion 18 of the wellbore 14, the probe assembly 12 generally includes a spear probe 32 and a straddle packer 34. The spear probe 32 is operable to radially extend a spear head 36 to contact and penetrate the geologic formation "G" as described in greater detail below. The straddle packer 34 is operable to isolate a portion of the wellbore 14. The straddle packer 34 includes at least two packer elements 38 axially spaced along a mandrel 40. In some embodiments, the straddle packer 34 also includes a port 34*a* disposed on the packer mandrel 40 between the packer elements 38, and inner flow passages 34*b* in fluid communication with the port 34 inner flow passage. As described in greater detail below, fluids may be injected into and collected from an annular space around the packer mandrel 40 through the port 34*a* and inner flow passages 34*b* (see, e.g., FIGS. 5C and 6E). The packer elements 38 may be selectively expanded in a radial direction from the mandrel 40 to sealingly contact a wall 42 of the wellbore 14. In some embodiments, the packer elements 38 may include expandable, elastomeric elements.

While the probe assembly 12 is presented herein in the context of straddle packer 34, the spear probe 32 may be used with any downhole tool or system. Among other things, the spear probe 32 can be utilized to conduct micro-fracture tests alone or in conjunction with a straddle packer 34; used to inject proppant into the geologic formation "G" and hold open mechanically induced fractures (see FIG. 4B) in the geologic formation "G" such that the spear probe 32 may be used to flow back reservoir fluid into the probe assembly 12. The probe assembly 12 may also be employed to create localized fracturing of the geologic formation "G" to inject pressurized fluid into the geologic formation "G," to inject other chemicals into the geologic formation "G," such as may be used for acidizing; to inject proppant into the geologic formation "G" and hold open mechanically induced fractures and/or to draw down samples of formation fluids.

The probe assembly 12 also includes a telemetry unit 44, a hydraulic fluid source 46, a pump 48 and one or more sample chambers 50 operably coupled to the spear probe 32 and the straddle packer 34. The telemetry unit 44 may include any wired or wireless communication system for receiving instructions from the surface location "S" or other locations in the wellbore system 10 for the spear probe 32, straddle packer 34 pump 48 and/or the various valves or other control mechanisms within the probe assembly 12.

Figure 2A:
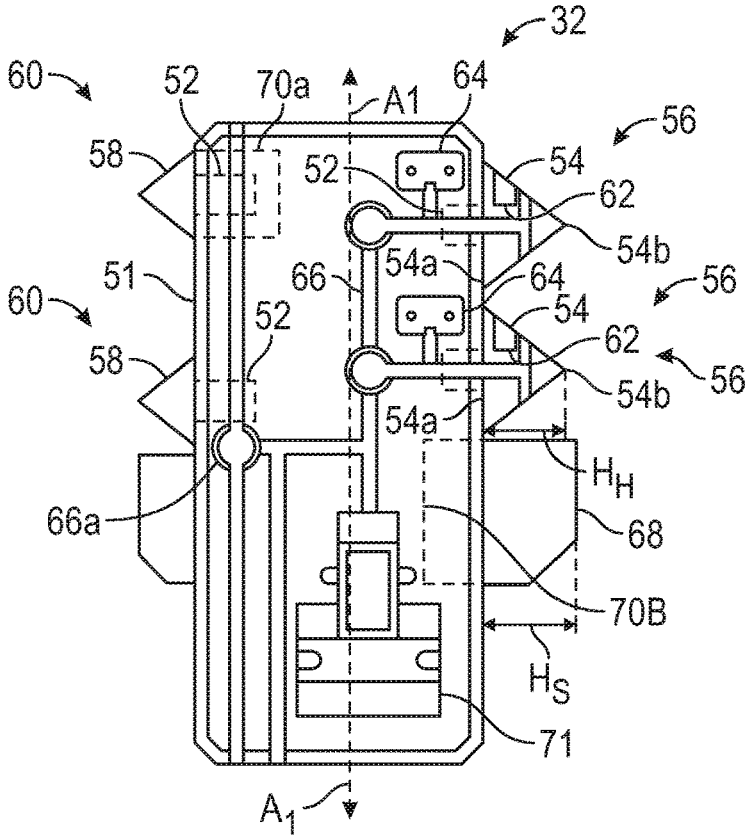
FIGS. 2A and 2B are schematic views of a spear probe, which may be employed in the probe assembly of FIG. 1, in respective retracted and extended configurations.
Figure 2B:
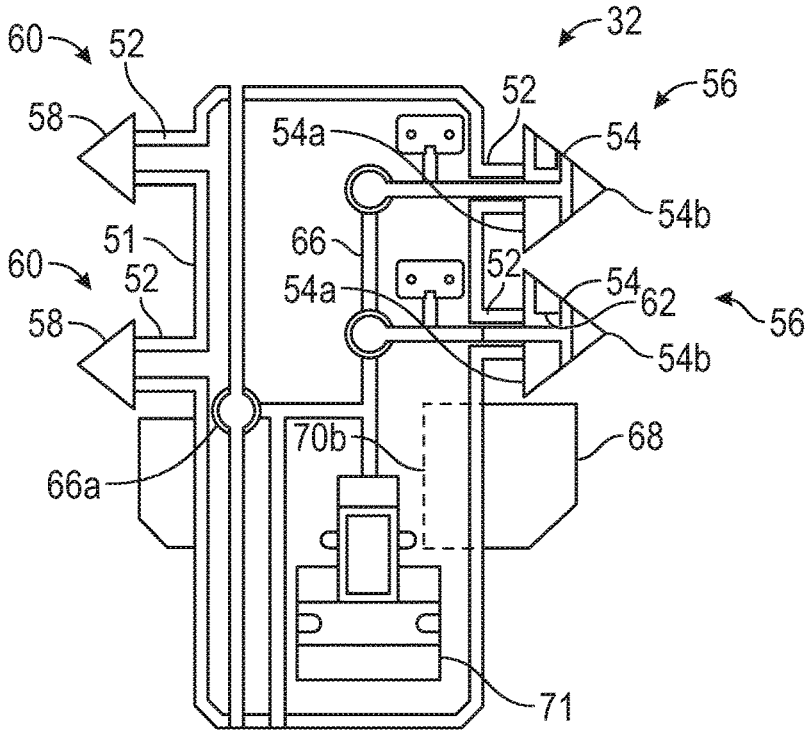

Referring to FIGS. 2A and 2B, the spear probe 32 is illustrated in retracted and extended configurations, respectively. The spear probe 32 includes a tool body 51 defining a tool axis $A_1$, with at least one radial extension mechanism 52 mounted on the tool body 51 at a first location on the tool body 51. The radial extension mechanism 52 is selectively operable to move between a first, retracted position (FIG. 2A) and a second, extended position (FIG. 2B). The radial extension mechanism 52 may be a piston chamber with a piston (not shown) adapted to reciprocate within piston chamber, wherein a shaped head 54 or spear tip is coupled to the piston. In other embodiments, the radial extension mechanism 52 may be a rotatable shaft, is while in other embodiments the extension mechanism 52 is a pivoting or jointed arm. The shaped head 54 or spear tip has a first or proximal end 54*a* attached to the extension mechanism 52 and a second or distal end 54*b* at which a vertex or point is formed. In some embodiments, the shaped head 54 may be pyramid shaped or comprised of at least three planar surface converging at the distal end 54*b* to form the vertex (see, e.g., FIG. 3E). In embodiments where the shaped head 54 is formed of two or more intersecting surfaces, the vertex is a point formed at the intersection of two or more curves, lines, or edges. In other embodiments, the shaped head 54 may be cone shaped, where the vertex is formed at the end of a curved surface. Together, the radial extension mechanism 52 and shaped head 54 define an extendable probe mechanism 56.

The spear probe 32 includes an additional or second extendable probe mechanism 56 disposed on the tool body 51. As illustrated, the shaped heads 54 of the extendable probe mechanisms 56 are axially separated and circumferentially aligned with one another on the tool body 51. In other embodiments, additional probe mechanisms 56 may be arranged any other spatial distribution on the tool body 51. In other embodiments, in addition to at least one extendable probe mechanism 56, a radial extension mechanism 52 may carry a traditional flat pad (see FIG. 7) rather than a shaped head 54. In this manner, a traditional probe mechanism may be combined with the embeddable probe mechanism described herein.

Alternatively, or in addition to the foregoing, the spear probe 32 may include a radial extension mechanism 52 mounted on the tool body 51 at a second location circumferentially or radially spaced apart from the first location. In some embodiments, the radial extension mechanism 52 may be spaced approximately 180 degrees about a circumference of the tool body 51 and may carry a shaped head 58 that is similar or dissimilar to the shaped head 54. In this manner an extendable probe mechanism 60 may be defined opposite the shaped head 54. In this regard, the extension mechanism 52 of extendable probe mechanism 60 be extended out against the wellbore wall 42 (FIG. 1). Continued application of force will drive the shaped head at 54 at the first location (on the opposite side of the tool body 51), into the geologic formation G (FIG. 1) as described herein. Thus, the shaped head 54 of the disclosure need not be carried on a radial extension mechanism 52 but may be driven into the geologic formation "G" by extension of the radial extension mechanism 52 on the opposite side of the tool body 51. In this regard, the shaped head 54 may be fixed along the tool body 51.

In some embodiments, the shaped head 54 head may include one or more sensors 62 mounted on or otherwise carried by the shaped head 54. The sensors 62 may be any sensor desired for use in measuring a characteristic or quality of the geologic formation "G" (FIG. 1), including, without limitation, a temperature sensor, a pressure sensor, a voltage sensor, an optic sensor, an impedance sensor, a resistivity sensor, a nuclear sensor or the like. In some embodiments, a pressure sensor 64 may be disposed within the tool body 51 in fluid communication with the shaped head 54 through inner flow passages 66 extending into the shaped head 54. The sensors 62 and/or pressure sensor 64 may be communicatively coupled to the telemetry unit 44 (FIG. 1) such that real-time information may be transmitted to the surface location "S."

In order to protect the shaped heads 54, 58 from damage as the spear probe 32 is moved through the wellbore 14 to the desired location for activation, the spear probe 32 may include one or more a standoffs 68 mounted on the tool body 51 adjacent the shaped heads 54, 58. The standoff 68 has a radial height "$H_S$" greater than a radial height "$H_H$ of the shaped heads 54, 58 in order to protect the shaped heads 54, 58 during tripping in and tripping out. In some other embodiments, a cavity 70*a* is formed in the tool body 58 so that the shaped heads 54, 58 can be withdrawn into the cavity by the radial extension mechanism 52. In other embodiments, the standoffs 68 may be retractable, e.g., movable from a first position in which the standoffs 68 extend radially beyond the distal ends 54*b* or vertex of the shaped head 54 to a second positions where the standoffs 68 are retracted radially inward into a cavity 70*b* or towards the tool body 51 relative to the first position, thereby permitting the standoffs 68 to be withdrawn into the tool body 51 during activation and use of the spear probe 32.

A pump 71 is provided within the tool body 51 in fluid communication with the inner flow passages 66. The pump 71 is selectively operable to move fluids through the inner flow passages 66, e.g., for the collection of fluids from the geologic formation "G" through the shaped heads 54 and into the sample chamber 50 (FIG. 1). The inner flow passages 66 include valve mechanisms 66*a*, which are operable to direct fluid to specific destinations through the inner flow passages. Additionally, or alternatively, the pump 71 may be selectively operable to inject fluids into the geologic formation "G" from the sample chamber 50. The pump 71 may be operably coupled to telemetry unit 44 (FIG. 1) to receive instructions therefrom.

Figure 3B:
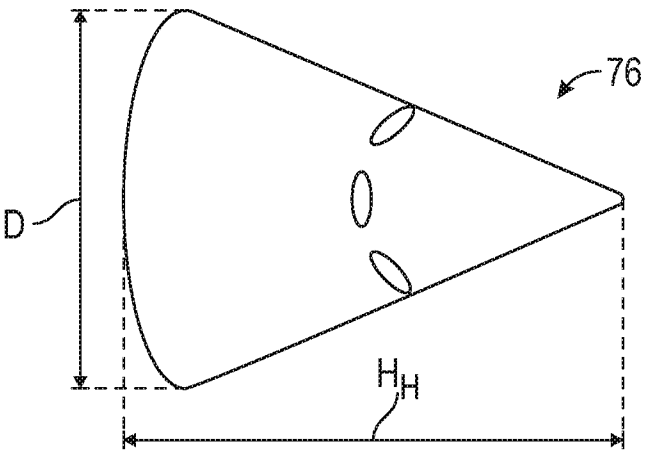
FIGS. 3A-3E are schematic of views of various spear tips or shaped heads, which may be installed on the spear probe of FIGS. 2A and 2B.
Figure 3A:
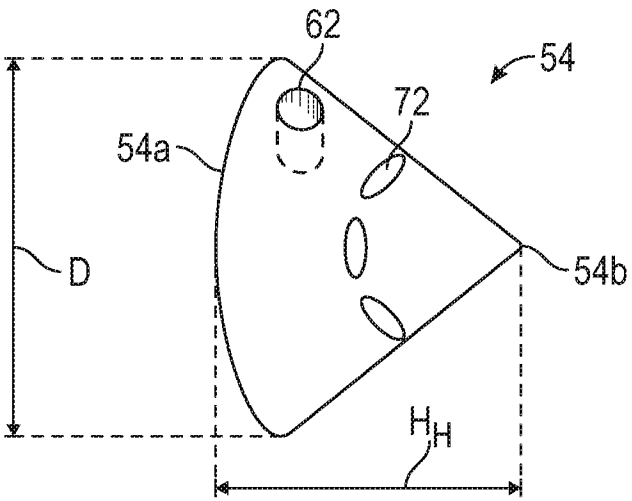

Referring to FIG. 3A, shaped head 54 is illustrated, which is installed on the spear probe 32 (FIG. 2A). As illustrated, the shaped head 54 is generally shaped as a cone, characterized by a vertex at the leading or distal end 54*b*. The pointed vertex permits the shaped head 54 to be driven into the geologic formation "G" (FIG. 1) under an application of force so that the shaped head 54 can be at least partially embedded in the geologic formation "G." In other embodiments, the shaped head 54 may exhibit a pyramid or prism shape, characterized by vertex at the leading end. In some embodiments, the distal end 54*b* of the shaped head 54 penetrates the geologic formation "G" to a depth that is at least half the radial height "$H_H$" of the shaped heads 54. In some embodiments, the distal end 54*b* of the shaped head 54 penetrates the geologic formation "G" to a depth that is sufficient to permit at least one port 72 on the probe to be positioned within the geologic formation "G" at a radial depth R beyond the wellbore wall 42 (see FIG. 4A). In some embodiments, at least two ports 72 are formed on the same circumference about the shaped head 54. In some embodiments, the distal end 54*b* of the shaped head penetrates the geologic formation "G" to a depth that is sufficient to permit at least one sensor 62 on the probe to be positioned within the geologic formation "G" at a depth beyond the wellbore wall 42. As illustrated, the shaped head 54 includes a plurality of circumferentially spaced ports 72, which are in fluid communication with the inner flow passages 66 (FIG. 2A). The ports 72 may be disposed at a radial height on the shaped head about half the radial height $H_H$ of the shaped head 54. As illustrated in FIG. 3A, the radial height $H_H$ of the shaped head 54 is approximately equal to a diameter D at the proximal end 54*a* if the shaped head.

In other embodiments, as illustrated e.g., in FIG. 3B, the radial height $H_H$ is greater than the diameter D. In this regard, the radial height $H_H$ may at least 1.5 the diameter D to form an elongated shaped head 76. The elongated shaped head 76 may permit the shaped head 76 to penetrate a geologic formation "G" with relatively low radial forces applied thereto. In some embodiments, the shaped heads 54, 56 may be constructed of a metal alloy selected based on characteristics of the geologic formation "G." Thus, in this regard, the shaped heads 54, 56 may be interchangeable, such that a first shaped head may be used at one depth in the wellbore 14 (FIG. 1) adjacent a first zone of the geologic formation "G" and a second shaped head may be used at a second depth in the wellbore adjacent a second zone of the geologic formation "G," where the first and second zones are different formation strata.

Figure 3D:
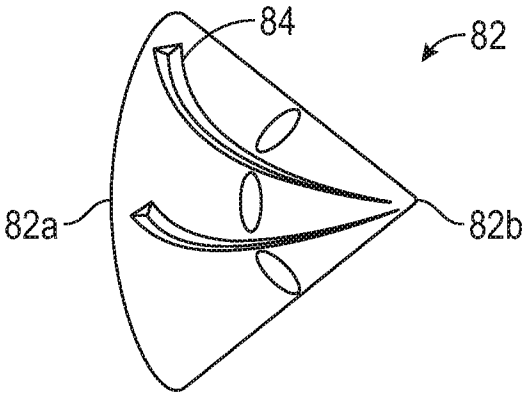
Figure 3C:
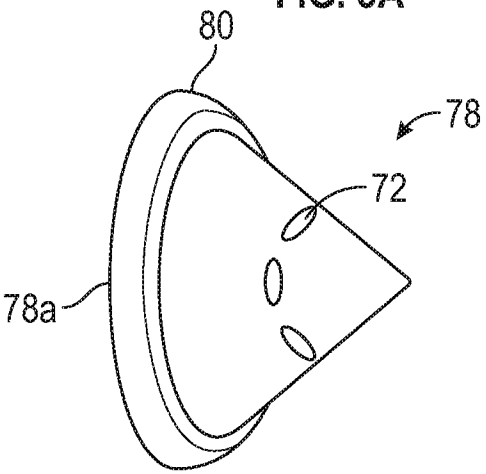
Figure 3E:
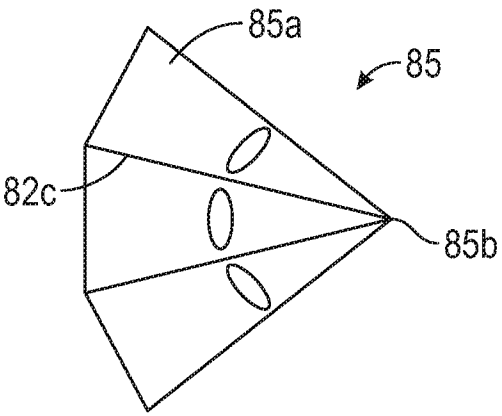

As illustrated in FIG. 3C, a shaped head 78 includes a sealing element 80 disposed around a proximal end 78*a* thereof. The sealing element 80 may form a seal with the wall 42 of the wellbore 14 (FIG. 1) when a spear probe to which the shaped head 78 is attached is moved to an extended configuration. The sealing element 80 may be constructed. e.g., of an elastomeric ring, and may promote fluid flow into the geologic formation "G" (rather than to leak back into the wellbore 14) in embodiments wherein a fluid is injected into the geologic formation "G" through the ports 72. As illustrated in FIG. 3D, a shaped head 82 includes one or more blades 84 formed along the outer surface of the shaped head 82 between a proximal end 82*a* and a distal end 82*b*. The blades 84 may be linear blades or spiral blades, as illustrated. The blades 84 may facilitate penetration of the shaped head 82 into the geologic formation "G." As illustrated in FIG. 3E, a shaped head 85 may be pyramid shaped or comprised of planar surfaces 85*a* converging at the distal end 85*b* to form a vertex. The vertex is a point formed at the intersection of edges 85*c* defined between the planar surfaces 85*a*.

Figure 4C:
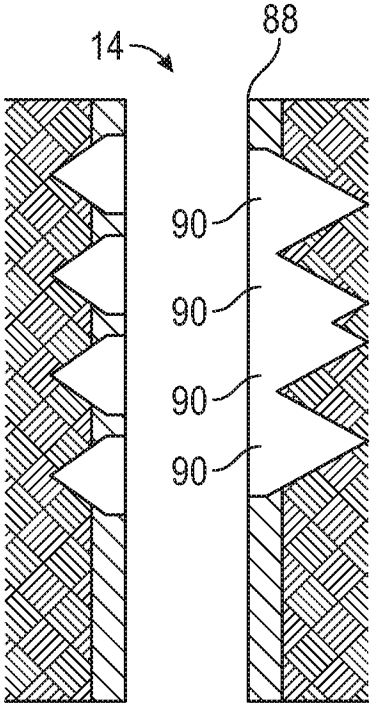
FIGS. 4B and 4C are enlarged views of the mechanical perforations formed in the geologic formation of FIG. 4A by extending the shaped heads in various locations.
Figure 4B:
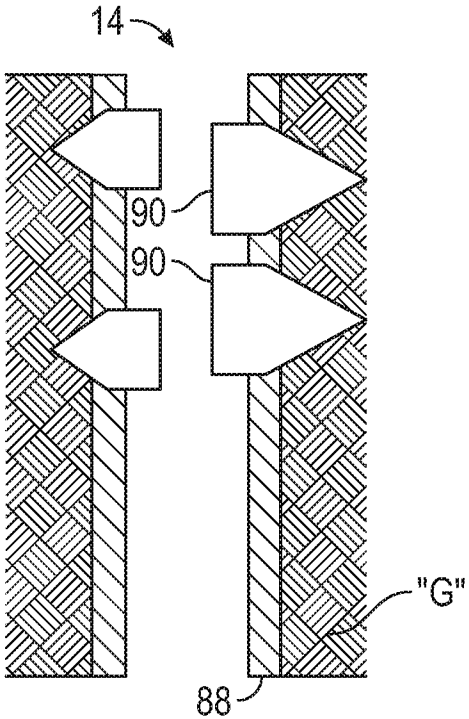
Figure 4A:
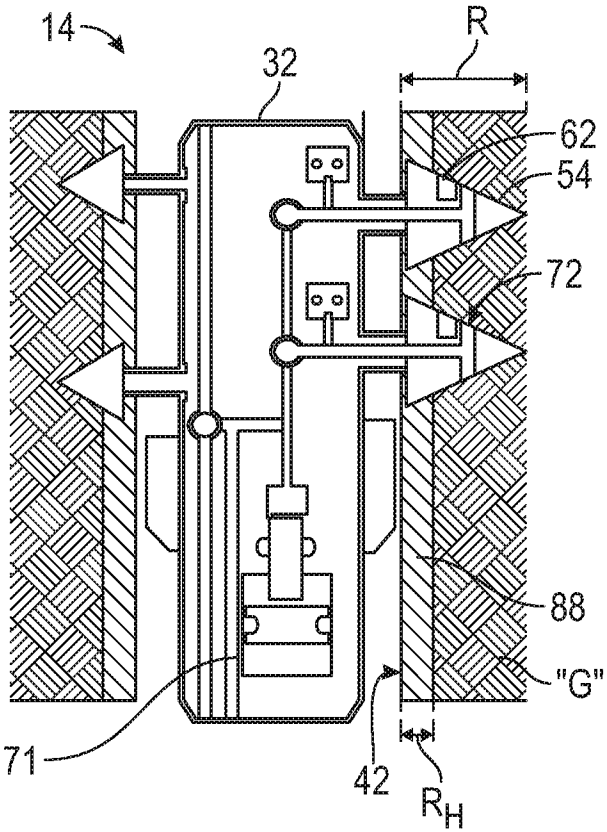
FIG. 4A is an enlarged schematic view of the spear probe of FIG. 2B in an extended configuration whereby shaped heads form mechanical perforations in the geologic formation.

Referring now to FIG. 4A, the spear probe 32 is illustrated in the extended configuration wherein the shaped head 54 is embedded in the geologic formation "G." In any event, driving the shaped heads 54 into the geologic formation "G" comprises penetrating the geologic formation "G" so that at least a portion of the shaped head 54 is embedded in the geologic formation "G." In some embodiments, the entire shaped head 54 may be embedded in the geologic formation, while in other embodiments, at least a sufficient portion of the shaped head 54 is buried in the geologic formation so that sensors 62 or ports 72 on the head are within the geologic formation "G." As illustrated, the shaped head 54 is embedded in the geologic formation "G" to a radial depth R from the wall 42 of the wellbore 14. A radial depth $R_H$ of a hoop stress regime 88 associated with the wellbore 14 is defined about the circumference of the wellbore wall 42. The radial depth $R_H$ may depend of various factors such as the depth from the surface location "S" (FIG. 1), the porosity of the surrounding geologic formation "G," the weight of drilling fluids or mud within the wellbore 14, etc. The shaped heads 54 are embedded into the geologic formation "G" such that the ports 72 and at least one sensor 62 are disposed radially beyond the radial depth $R_H$ of the hoop stress regime 88. The ports 72 and the at least one sensor 62 thus communicate with the geologic formation "G" in a region relatively unaffected by the hoop stress associated with the wellbore 14.

Among other things, the shaped head 54 may be employed to measure a pressure or temperature of the geologic formation "G," position sensor 62 in the geologic formation "G," at a location beyond the wall 42 of the wellbore 14, draw down formation fluid from within the geologic formation "G" (as opposed to from the wellbore wall 42), inject a proppant into the geologic formation "G," inject a treatment fluid into the geologic formation "G," including acidizing the geologic formation "G," induce a mechanical fracture 90 (FIG. 4B) in the geologic formation "G, and/or penetrate the hoop stress regime 88 about the wellbore 14. In some embodiments, the shaped head 54 may be used to accomplish multiple operations at the same time, such as inducing mechanical fractures 90 in the geologic formation "G" and then is drawing down a formation fluid or injecting a treatment fluid or proppant into the geologic formation "G."

In some embodiments, feedback from the at least one sensor 62 and/or feedback from the pressure sensor 64 may be monitored as the spear probe 32 is moved from the retracted to extended condition. A characteristic of the geologic formation "G" that is dependent on the radial depth R from the wellbore may be ascertained at a plurality of radial depths R to determine whether the radial depth $R_H$ of the hoop stress regime 88 had been surpassed. For example, a pressure reading from at least one of the sensors 62, 64 may be taken at increments of radial depth R, e.g., 0.1 inch, and the change in pressure between readings may be monitored. When the change in pressure readings below a predetermined threshold is observed, the hoop stress regime 88 may have been sufficiently penetrated.

In some embodiments, a wellbore operation may be performed while the spear probe 32 remains in the extended configuration wherein the ports 72 on the shaped heads 58 are beyond the radial depth $R_H$ of the hoop stress regime 88. For example, the pump 71 may be activated to draw down a formation fluid or to deliver a treatment fluid from the sample chambers 50 (FIG. 1) through the ports 72 and into the geologic formation "G" beyond the hoop stress regime 88. The treatment fluid may tend to remain within the geologic formation "G," while the hoop stress regime 88 discourages the treatment fluid from leaking back into the wellbore 14.

Referring to FIG. 4B, in other embodiments, a wellbore operation may be performed once the spear probe 32 (FIG. 4A) is returned to the retracted configuration (FIG. 2B) and moved within the wellbore 14 such that mechanical fractures 90 remain in the geologic formation "G" at the desired location. The mechanical fractures 90 are formed by withdrawing the shaped heads 58 and provide a fluid pathway between the wellbore 14 and geologic formation "G" through the hoop stress regime 88. In some embodiments, as illustrated in FIG. 4C, the spear probe 32 may be moved to extended configuration at axially spaced locations within the wellbore to form axially spaced and/or overlapping mechanical fractures 90, e.g., to provide a lager fluid pathway through the hoop stress regime 88.

Figure 5D:
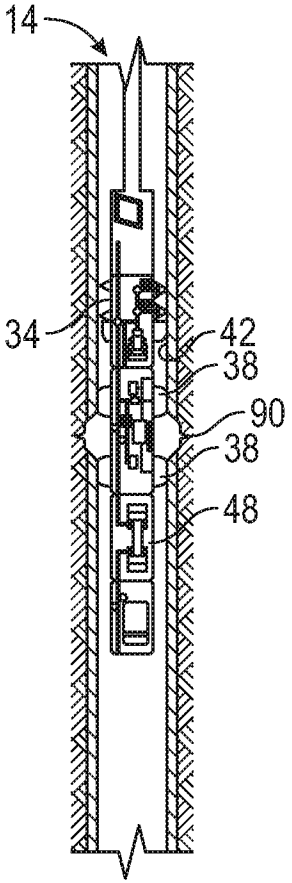
FIGS. 5A-5D are schematic views of the probe assembly of FIG. 1 in sequential operational steps for establishing communication with the geologic formation beyond a hoop stress regime surrounding the wellbore.
Figure 5C:
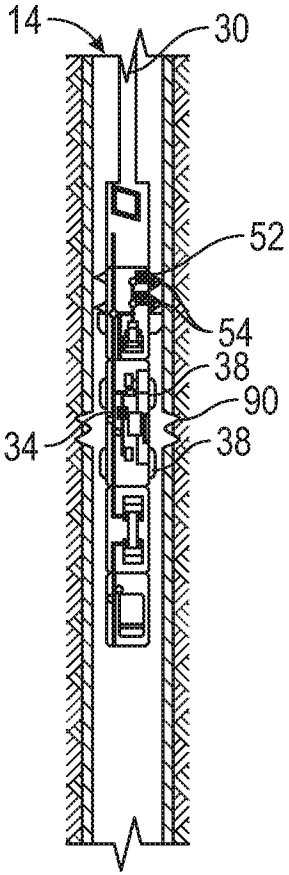
Figure 5B:
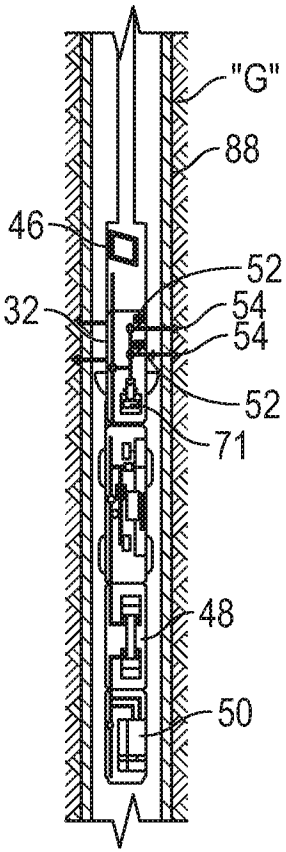
Figure 5A:
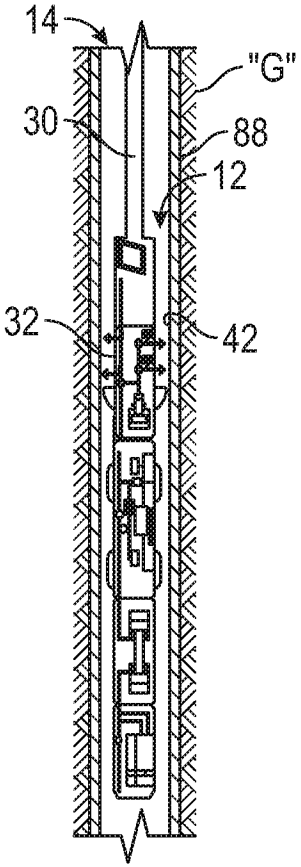

Referring to FIG. 5A through 5D, the probe assembly 12 is illustrated in sequential operational steps for establishing communication with the geologic formation "G" beyond the hoop stress regime 88 surrounding the wellbore 14. Initially, the probe assembly 12 is maneuvered with the conveyance 30 to a desired position in the wellbore 14 (FIG. 5A). Once the probe assembly 12 is positioned such that the spear probe 32 is adjacent the wellbore wall 42 at the location where the hoop stress regime is to be penetrated, the spear probe 32 is moved to the extended configuration (FIG. 5B). The shaped heads 54 are forced by the radial extension mechanisms 52 through the hoop stress regime 88 to be embedded in the geologic formation "G." In some embodiments, the pump 48 may be employed to deliver hydraulic fluid from the hydraulic fluid source 46 to the radial extension mechanisms 52 on the spear probe 32, and thereby move the radial extension mechanisms 52 to the extended configuration. In this regard, radial extension mechanisms 52 may include a piston chamber (not shown) having a first chamber and a second chamber, where the two chambers are divided by a piston. Hydraulic fluid may be delivered to the first chamber to extend the shaped head 54 (and may subsequently be delivered to the second chamber to retract the shaped head 54), with a valve mechanism adapted for controlling the introduction of the fluid into the two chambers as desired. In any event, for such embodiments, the radial extension mechanism may be hydraulically activated.

When the spear probe 32 is in the extended configuration illustrated in FIG. 5B, the sensors 62 (FIG. 2B) may be monitored to verify that the shaped heads 54 have been delivered through the hoop stress regime 88 as described above. Additionally, the pump 71 may be activated to inject a treatment fluid from one of the sample chambers 50 directly into the geologic formation "G" beyond the hoop stress regime 88.

As illustrated in FIG. 5C, the radial extension mechanisms 52 may be activated to return to the radial extension mechanisms 52 to their retracted configurations and withdraw the shaped heads 54 from the geologic formation "G." Mechanical fractures 90 extending through the hoop stress regime are 88 are formed by the withdrawal of the shaped heads 54. The conveyance 30 may then be raised to position the straddle packer 34 adjacent the mechanical fractures 90. Specifically, straddle packer 34 is positioned such that the packer elements 38 are positioned on opposite axial sides of the mechanical fractures 90. Next, as illustrated in FIG. 5D, the packer elements 38 may be radially expanded to form a seal with the wellbore wall 42 on the opposite lateral sides of the mechanical fractures 90. In some embodiments, the packer elements 38 may be expanded, e.g., by operating the pump 48 to deliver hydraulic fluid thereto. Once the packer elements 38 are expanded, the mechanical fractures 90 are fluidly isolated from the wellbore 14 above and below the packer elements 38. The pump 48 may again be activated to deliver a fracturing fluid from the sample chambers 50 (or from a different source) to the wellbore 14 between the packer elements 38. The fluid delivered may widen the mechanical fractures 90, and a micro-fracturing operation may thereby be performed.

Figure 6D:
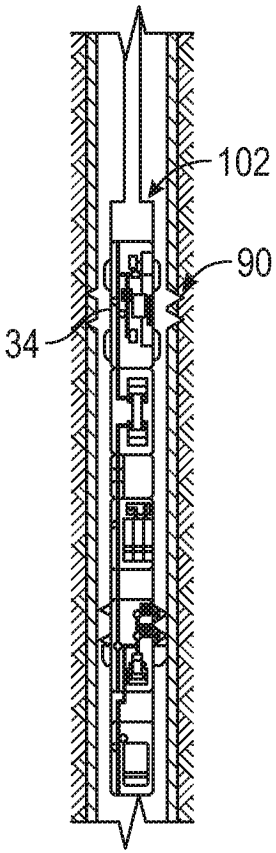
FIGS. 6A-6F are schematic views of an alternate embodiment of a probe assembly in sequential operational steps for injecting a fluid into the geologic formation beyond a hoop stress regime surrounding the wellbore.
Figure 6C:
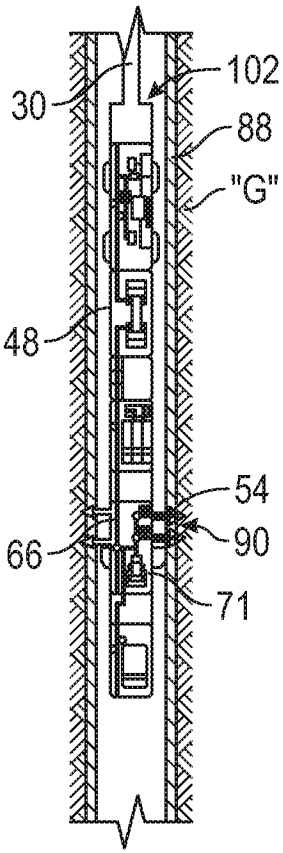
Figure 6B:
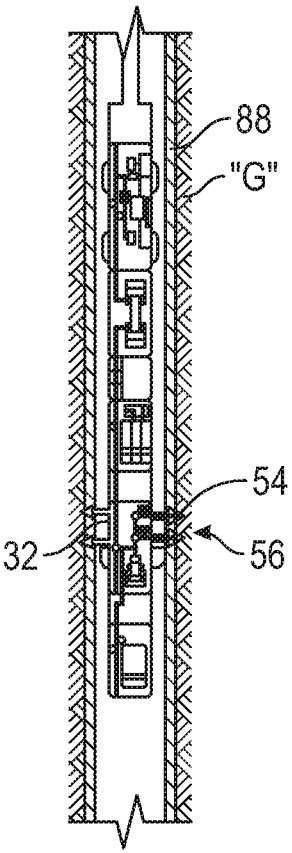
Figure 6A:
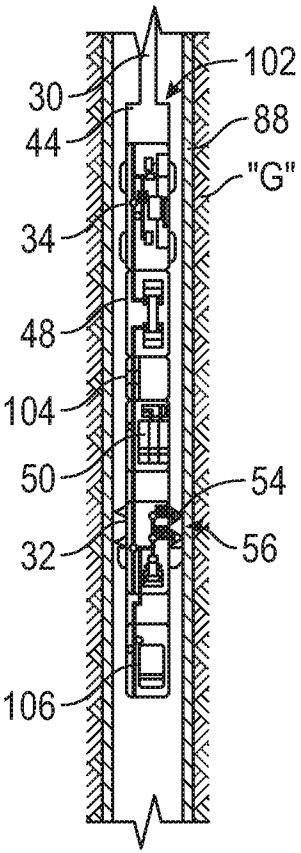
Figure 6F:
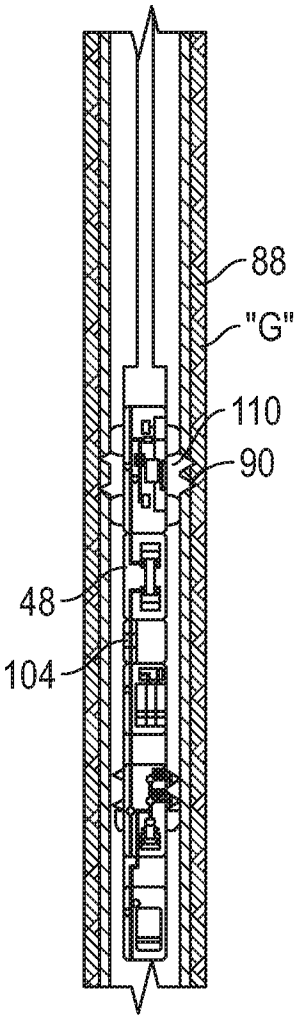
Figure 6E:
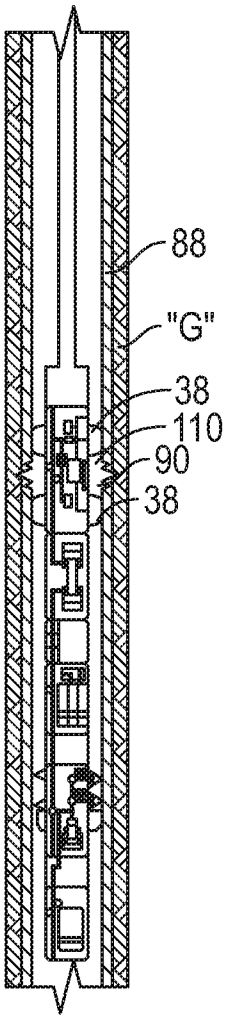

Referring now to FIGS. 6A through 6F, a method of employing spear probe 32 in a probe assembly 102 is described for injecting a fluid into the geologic formation "G." As illustrated in FIG. 6A, the probe assembly 102 may be carried by conveyance 30 as described above. The telemetry unit 44 may be provided to receive instructions and/or control the straddle packer 34, pump 48, spear probe 32 and other components of the probe assembly 102. The probe assembly 102 also includes a fluid ID module 104, which may be used to analyze fluids drawn down from the geologic formation "G," the fluid sample chambers 50 and a proppant chamber 106. The probe assembly 102 is initially lowered into position with the conveyance 30.

Next, as illustrated in FIG. 6B, the spear probe 32 is actuated to extend the extendable probe mechanisms 56 into the geologic formation "G" through the hoop stress regime 88. With the shaped heads 54 embedded in the geologic formation "G" proppant may be pumped from the proppant chamber 106 (see FIG. 6C) into the mechanical fractures 90 and geologic formation "G" through the shaped heads 54. The pump 71 carried by the spear probe 32 may be employed, or the pump 48, or another mechanism in fluid communication with the inner flow passages 66. Probe assembly 102 may be moved with conveyance 30 to several axially-spaced desired test locations, and proppant may be pumped beyond the hoop stress regime 88 at several different axial locations in the wellbore 14. The proppant pumped into the geologic formation "G" may facilitate a microfracture test as described in greater detail below.

As illustrated in FIG. 6D, the spear probe 32 may be returned to the retracted configuration and the probe assembly 102 may then be moved to position the straddle packer 34 adjacent the mechanical fractures 90. Next, the packer elements 38 may be expanded, and proppant may be pumped from the proppant chamber 106 into an annular space 110 between the packer elements 38. The pump 48 may be employed to pressurize the annular space 110 and thereby perform a hydraulic micro-fracturing operation wherein the mechanical fractures 90 are expanded (see FIG. 6E). The proppant may be pumped through the mechanical fractures 90 to enter the geologic formation "G" beyond the hoop stress regime 88. Next, as illustrated in FIG. 6F, the operation of the pump 48 may be halted, permitting a pressure in the annular space 110 to be lowered and permitting fluid to flow back from the geologic formation "G." Fluid may flow back through the mechanical fractures 90, which may remain open even in the event hydraulic fractures formed by pressurizing annular space 110 are closed. The fluid that flows back into the annular space 110 may be collected and analyzed with the fluid ID module 104. Since the mechanical fractures 90 facilitate fluid interaction with the geologic formation "G" beyond the hoop stress regime 88, the fluid analyzed by the fluid ID module may provide more relevant information about the geologic formation "G."

Figure 7:
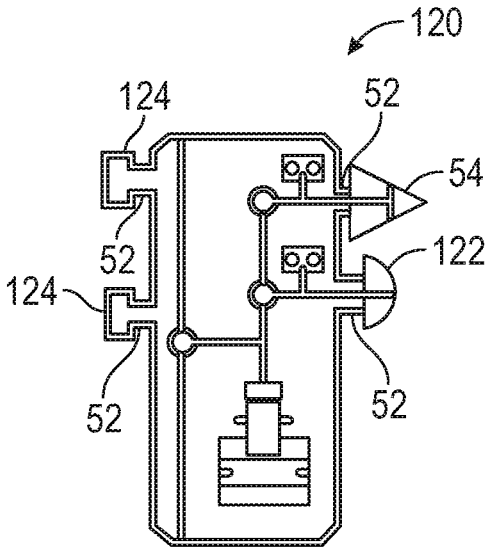
FIG. 7 is a schematic view of an alternate embodiment of a spear probe including shaped head and a standard probe head opposite flat heads.

As illustrated in FIG. 7, an alternate embodiment of a spear probe 120 includes a shaped head 54 as described above, as well as a standard probe head 122 opposite flat heads 124. Radial extension mechanisms 52 may be provided with each of the heads 54, 122 and 124, and may be activated, independently or in conjunction with other radial extension mechanisms 25, to move the spear probe 120 from a retracted configuration to the extended configuration illustrated. In some embodiments, the spear probe 120 may be employed to embed shaped head 54 into the geologic formation "G" beyond the hoop stress regime 88 (FIG. 1), while the standard probe head 122 may be extended to contact the borehole wall 42. Thus, fluid collected from the two probe heads 54, 122 may be analyzed to compare conditions on each side of the hoop stress regime 88.

Figure 8:
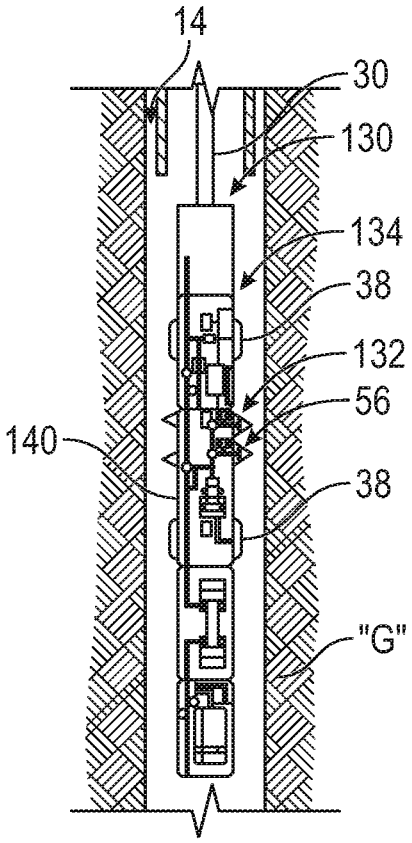
FIG. 8 is a schematic view of an alternate embodiment of a probe assembly illustrating a spear probe assembly positioned between packer elements on a mandrel of a straddle packer.

FIG. 8 is a schematic view of an alternate embodiment of a probe assembly 130 illustrating a spear probe 132 positioned between packer elements 38 of a straddle packer 134. The packer elements 38 are radially expandable about a mandrel 140, which also serves as a tool body for radially extendable probe mechanisms 56. With the radially extendable probe mechanisms 56 positioned axially between the packer elements 38, a microfracture test may be performed as described above without repositioning the probe assembly 130. Thus, in some embodiments, the packer elements 38 may be expanded prior to creating mechanical fractures 90 and/or injecting proppant into the geologic formation "G."

In use, the probe assemblies 12, 102, 130 the present disclosure can be incorporated in conveyance 30 or any working string of an operation, such as drilling, eliminating the need to conduct separate trips into the wellbore in order to collect data utilizing the probe. Thus, the probe assemblies 12, 102, 130 may obviate the need for retracting the working string, such as a drill string, from the wellbore 14, and subsequently lowering a separate work string or wireline containing the probe equipment must be lowered into the wellbore 14 to conduct secondary operations. Interrupting a drilling process to perform formation testing can add significant time and expensed to a drilling or other wellbore operation.

The aspects of the disclosure described below are provided to describe a selection of concepts in a simplified form that are described in greater detail above. This section is not intended to identify key features or essential features of the claimed subject matter, nor is it intended to be used as an aid in determining the scope of the claimed subject matter.

According to one aspect, the disclosure is directed to a downhole tool. The downhole tool includes a tool body defining a longitudinal axis, a radial extension mechanism mounted on the tool body at a first location on the tool body and movable between a radially retracted configuration and a radially extended configuration with respect to the tool body. A shaped head has a proximal end attached to the radial extension mechanism and a distal end at which a vertex is formed. The downhole tool further includes a straddle packer including a mandrel coupled to the tool body, first and second packer elements axially spaced from one another along the mandrel and a fluid port defined in the mandrel between the first and second packer elements.

In some embodiments, the downhole tool further includes a proppant chamber and a pump operable to deliver fluid from the proppant chamber to the fluid port defined in the mandrel. The downhole tool may further include a port defined on the shaped head, the port in fluid communication with the proppant chamber.

In one or more example embodiments, the shaped head includes a sensor thereon, the sensor comprising at least one of the group consisting of a temperature sensor, a pressure sensor, a voltage sensor, an impedance sensor, a resistivity sensor, a nuclear sensor and an optic sensor. The shaped head may include a sealing element disposed about the proximal end thereof.

In some embodiments the radial extension mechanism may be mounted axially between the first and second packer elements. The downhole tool may further include a second radial extension mechanism mounted on the tool body at a second location, wherein the second location is radially spaced apart approximately 180 degrees about a circumference of the tool body from the first location.

In some example embodiments, the downhole tool may further include a wireline coupled to the tool body and operable to move the tool body axially within the wellbore. In some embodiments, the downhole tool further includes a standoff mounted on the tool body adjacent the shaped head According to another aspect, the disclosure is directed to a method of evaluating a geologic formation surrounding a wellbore. The method includes (i) conveying a probe assembly into a wellbore to position the probe assembly at a downhole location, (ii) radially extending a shaped head from a tool body of the probe assembly to thereby embed the probe into the geologic formation and form mechanical fractures therein, (iii) injecting a fluid into the mechanical fractures, and (iv) sensing a characteristic of the of the fluid injected.

In one or more example embodiments, the method further includes radially expanding first and second packer elements of the probe assembly on opposite axial sides of the mechanical fractures to thereby fluidly isolate an annular space around the probe assembly. In some embodiments, injecting a fluid into the mechanical fractures includes pressurizing the annular space around the probe assembly. Injecting a fluid into the mechanical fractures may further include pumping fluid through ports defined in the shaped head while the shaped head is embedded in the geologic formation.

In some embodiments, the method further includes conveying the probe assembly to position the first and second packer elements on opposite axial sides of the mechanical fractures. The first and second packer elements may be radially expanded prior to radially extending the shaped head from an axial location between the first and second packer elements.

In example embodiments, the method further includes measuring a characteristic of the geologic formation with a sensor on the shaped head embedded in the geologic formation. The method may further include drawing down fluid from the geologic formation through the shaped head while the shaped head is embedded in the geologic formation. Conveying the probe assembly into the wellbore may include conveying the probe assembly on a wireline. In some embodiments, the method may further include determining a radial depth of a hoop stress regime surrounding the wellbore, and wherein the radially extending the shaped head includes penetrating the geologic formation by at least the radial depth of the hoop stress regime. Determining a radial depth of the hoop stress regime may include monitoring feedback from a sensor on the shaped head as the shaped head is extended radially to determine when a predetermined threshold is reached for a change in a characteristic measured by the sensor.

The Abstract of the disclosure is solely for providing the United States Patent and Trademark Office and the public at large with a way by which to determine quickly from a cursory reading the nature and gist of technical disclosure, and it represents solely one or more examples.

While various examples have been illustrated in detail, the disclosure is not limited to the examples shown. Modifications and adaptations of the above examples may occur to those skilled in the art. Such modifications and adaptations are in the scope of the disclosure.

What is claimed is:

1. A method of evaluating a geologic formation surrounding a wellbore, the method comprising:

deploying a downhole tool into the wellbore, the downhole tool comprising:

a tool body defining a longitudinal axis;

a radial extension mechanism mounted on the tool body at a first location on the tool body and movable between a radially retracted configuration and a radially extended configuration with respect to the tool body;

a shaped head having a proximal end attached to the radial extension mechanism and a distal end at which a vertex is formed; and a straddle packer including a mandrel coupled to the tool body, first and second packer elements axially spaced from one another along the mandrel and a fluid port defined in the mandrel between the first and second packer elements;

moving the radial extension mechanism from the radially retracted configuration to the radially extended configuration to thereby radially extend the shaped head and penetrate the geologic formation with the shaped head;

sensing a characteristic of the geologic formation through the shaped head as the shaped head is radially extended to a plurality of increments of radial depth into the geologic formation;

determining that the shaped head has reached a radial depth beyond a hoop stress regime by observing that a change in the characteristic of the geologic formation sensed is below a predetermined threshold;

injecting a fluid into the geologic formation; and sensing a characteristic of the of the fluid injected through the shaped head.

2. The method according to claim 1, further comprising pumping the fluid from a proppant chamber to the fluid port defined in the mandrel.

3. The method according to claim 2, further comprising injecting the proppant through a port defined on the shaped head, the port in fluid communication with the proppant chamber.

4. The method according to claim 1, further comprising measuring a characteristic of the geologic formation with a sensor on the shaped head, the sensor comprising at least one of the group consisting of a temperature sensor, a pressure sensor, a voltage sensor, an impedance sensor, a resistivity sensor, a nuclear sensor and an optic sensor.

5. The method according to claim 1, forming a seal with a wall of the wellbore with a sealing element disposed about the proximal end of the shaped head.

6. The method according to claim 1, wherein moving the radial extension mechanism comprises penetrating the geologic formation axially between the first and second packer elements.

7. The method according to claim 1, further comprising extending a second radial extension mechanism mounted on the tool body at a second location, wherein the second location is radially spaced apart approximately 180 degrees about a circumference of the tool body from the first location.

8. The method according to claim 1, further comprising moving the tool body axially within the wellbore with a wireline coupled to the tool body.

9. The method according to claim 1, further comprising deploying the downhole tool into the wellbore comprises tripping the shaped head into the wellbore adjacent a standoff mounted on the tool body.

10. The method according to claim 1, further comprising expanding the first and second packer elements and injecting the fluid into the geologic formation.

11. A method of evaluating a geologic formation surrounding a wellbore, the method comprising:

determining a radial depth of a hoop stress regime surrounding the wellbore;

conveying a probe assembly into the wellbore to position the probe assembly at a downhole location;

radially extending a shaped head from a tool body of the probe assembly to thereby penetrate the geologic formation by at least the radial depth of the hoop stress regime, embed the shaped head into the geologic formation and form mechanical fractures therein;

injecting a fluid into the mechanical fractures; and sensing a characteristic of the of the fluid injected.

12. The method according to claim 11, further comprising radially expanding first and second packer elements of the probe assembly on opposite axial sides of the mechanical fractures to thereby fluidly isolate an annular space around the probe assembly.

13. The method according to claim 12, wherein injecting a fluid into the mechanical fractures includes pressurizing the annular space around the probe assembly.

14. The method according to claim 13, wherein injecting a fluid into the mechanical fractures further includes pumping fluid through ports defined in the shaped head while the shaped head is embedded in the geologic formation.

15. The method of claim 12, further comprising conveying the probe assembly to position the first and second packer elements on opposite axial sides of the mechanical fractures.

16. The method according to claim 12, wherein the first and second packer elements are radially expanded prior to radially extending the shaped head from an axial location between the first and second packer elements.

17. The method according to claim 11, further comprising measuring a characteristic of the geologic formation with a sensor on the shaped head embedded in the geologic formation.

18. The method according to claim 11, further comprising drawing down fluid from the geologic formation through the shaped head while the shaped head is embedded in the geologic formation.

19. The method according to claim 11, wherein conveying the probe assembly into the wellbore includes conveying the probe assembly on a wireline.

20. The method according to claim 11, wherein determining a radial depth of the hoop stress regime includes monitoring feedback from a sensor on the shaped head as the shaped head is extended radially to determine when a predetermined threshold is reached for a change in a characteristic measured by the sensor.

* * * * *